United States Patent [19]

Handel

[11] 4,338,543

[45] Jul. 6, 1982

[54] CRT WITH ARC SUPPRESSION MEANS THEREIN

[75] Inventor: Richard R. Handel, Lancaster, Pa.

[73] Assignee: RCA Corporation, New York, N.Y.

[21] Appl. No.: 48,827

[22] Filed: Jun. 15, 1979

[51] Int. Cl.[3] ..... H01J 29/46; H01J 29/82

[52] U.S. Cl. ..... 313/457; 313/417

[58] Field of Search ..... 313/417, 414, 457, 449

[56] References Cited

U.S. PATENT DOCUMENTS 3,355,617 11/1967 Schwartz et al. ..... 313/450
3,558,954 1/1971 Lilley ..... 313/414
3,771,003 11/1973 Kerr et al. ..... 313/239 X

FOREIGN PATENT DOCUMENTS 1299329 12/1972 United Kingdom ..... 313/414

*Primary Examiner*—Robert Segal
*Attorney, Agent, or Firm*—E. M. Whitacre; G. H. Bruestle; L. Greenspan

[57] ABSTRACT

A CRT comprising an evacuated envelope having an electrically-insulating neck and a beaded electron-gun mount assembly housed in the neck. The beads of the assembly are closely spaced from the inner surface of the neck. An electrically-conducting band is located against the surface, each bead opposite the neck. The band is electrically connected to and supported from one of the electrodes of the mount assembly.

3 Claims, 5 Drawing Figures

CRT WITH ARC SUPPRESSION MEANS THEREIN

CROSS-REFERENCE TO RELATED APPLICATION

This application relates to, but is not dependent upon, copending application Ser. No. 18,907 filed Mar. 9, 1979 by Karl G. Hernqvist, now U.S. Pat. No. 4,284,694 issued Aug. 18, 1981, and having a common assignee herewith.

BACKGROUND OF THE INVENTION

This invention relates to a novel CRT (cathode-ray tube) having means for suppressing arcing therein; and particularly for suppressing flashovers in the neck of a CRT having a beaded mount assembly.

A color television picture tube is a CRT which comprises an evacuated glass envelope including a viewing window which carries a luminescent viewing screen, and a glass neck which houses an electron-gun mount assembly for producing one or more electron beams for selectively scanning the viewing screen. Each gun comprises a cathode and a plurality of electrodes supported as a unit in spaced tandem relation from at least two elongated, axially-oriented, electrically-insulating support rods, which are usually in the form of glass rods, commonly termed beads. The beads have extended surfaces closely spaced from and facing the inner surface of the glass neck. The beads usually extend from the region close to the stem, where the ambient electric fields are small, to the region of the electrodes to which the highest operating potential is applied, where the ambient electric fields are high during the operation of the tube. The spaces between the beads and the neck surfaces are channels in which leakage currents may travel from the stem region up to the region of the highest-potential electrode. These leakage currents are associated with blue glow in the neck glass, with charging of the neck surface and with arcing or flashover in the neck. The driving field for these currents is the longitudinal component of the electric field in the channel.

Several expedients have been suggested for blocking or reducing these leakage currents. Coatings on the neck glass are partially effective to prevent arcing but are burned through when arcing does occur. U.S. Pat. No. 3,558,954 issued Jan. 26, 1971, to C. E. Lilley discloses positioning a closed, split or segmented wire suppressor ring in the channel, around the mount assembly and outwardly spaced from the support rods or beads. The suppressor ring may be electrically connected to the focus grid electrode, or to ground or to a separate low-voltage source. This structure is at least partially effective in suppressing arcing. However, because it is outwardly spaced and is supported from a stem lead, it is difficult to position properly and, also, it is difficult to maintain that position during subsequent processing and use.

SUMMARY OF THE INVENTION

The novel CRT comprises an evacuated envelope including a neck of glass or other insulating material. An electron-gun mount assembly, including a plurality of electrodes mounted on at least two electrically-insulating support rods, is housed in the neck with the rods closely spaced from the inside of the neck. An electrically-conducting band part is located against the surface of each support rod facing the neck. Each of the band parts is connected to and supported from the focus grid electrode. In one embodiment, a single metal ribbon encircles the mount assembly and is welded to the focus grid electrode. In another embodiment, there is a separate metal ribbon around each support rod or bead, which is welded to the focus grid electrode.

DETAILED DESCRIPTION OF THE PREFERRED EMBODIMENT

Figure 3:
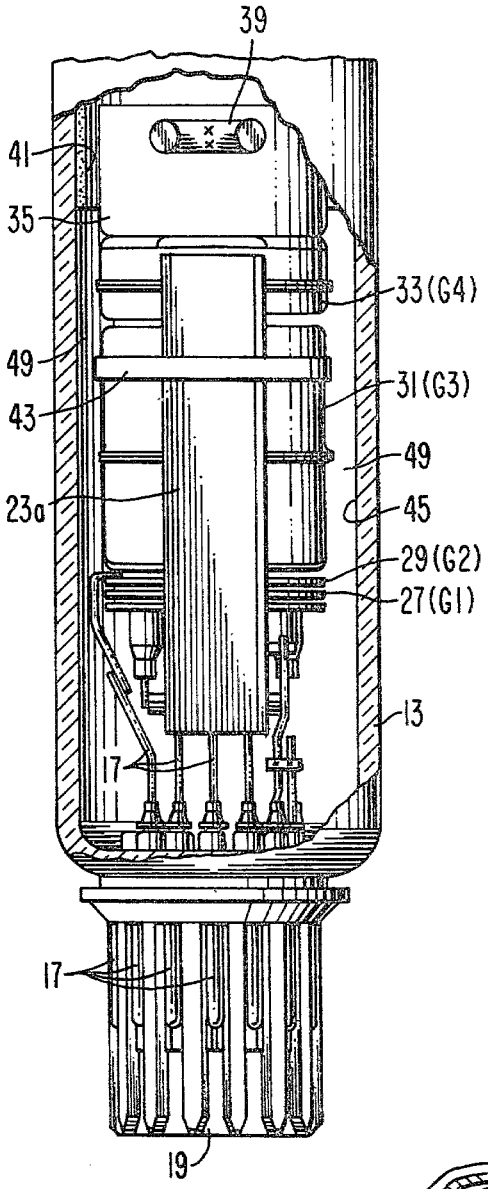
FIG. 3 is a broken-away, side, elevational view along section line 3—3 of the neck of the CRT shown in FIG. 1.
Figure 1:
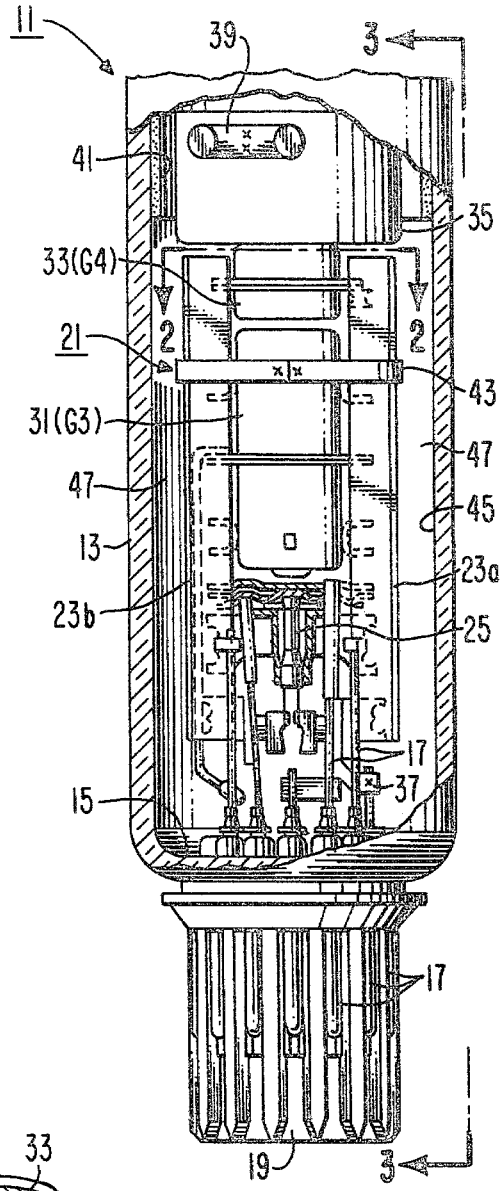
FIG. 1 is a broken-away, front, elevational view of the neck of a first embodiment of the novel CRT.
Figure 2:
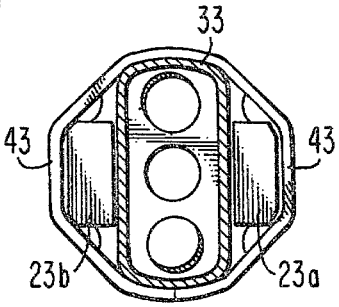
FIG. 2 is a sectional plan view along section line 2—2 through the neck of the CRT shown in FIG. 1.

FIGS. 1, 2 and 3 show structural details of the neck of a particular shadow-mask-type color television picture tube. The structure of this CRT, which is a rectangular 19 V size tube with 90° deflection, is conventional except for the electron-gun mount assembly. The structural details thereof are similar to those described in U.S. application Ser. No. 895,588 filed Apr. 12, 1978 by R. H. Hughes et al. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base 19 is attached to the pins 17 outside the envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly comprises two glass support rods or beads **23*a* and 23*b* from which the various electrodes are supported to form a coherent unit in a manner commonly used in the art. These electrodes include three substantially equally transversely spaced coplanar cathodes 25 (one for producing each beam), a control-grid electrode (also referred to as G1) 27, a screen grid electrode (also referred to as G2) 29, a focus grid electrode or first accelerating and focusing electrode (also referred to as G3) 31, a second accelerating and focusing electrode (also referred to as G4) 33, and a shield cup 35, longitudinally spaced in that order by the beads 23*a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 on the shield cups 35 which press on and make contact with an electrically-conducting internal coating 41 on the inside surface of the neck 13. The internal coating 41** extends over the inside surface of the funnel and connects to the anode button (not shown).

Each of the beads 23*a* and 23*b* is about 10 mm (millimeters) wide by 25 mm long. A single metal ribbon 43 encircles the mount assembly over the G3 near the end toward the G4; that is, the high-voltage end of the G3. The ribbon 43 lays against those bead surfaces that face the inside surface 45 of the neck 13. In this example, the ribbon 43 is about 2.0 mm wide and about 0.1 mm thick and is composed of a nonmagnetic stainless steel alloy. The ribbon 43 is welded near each of its ends to the G3. Each weld is indicated by a small "x" in FIG. 1.

The tube may be operated in its normal way by applying operating voltages to the pins 17 and to the internal coating 41 through the anode button; which, for example, are typically less than 100 volts on G1, about 600 volts on G2, about 8,000 volts on G3 and about 30,000 volts on G4. Because of the beaded structure described, the regions between the beads and the neck, which can be called the bead channels 47, behave differently from the regions between the neck and the other parts of the mount assembly, which can be called the gun channels 49. Arcing (flashover), when it occurs, occurs in the bead channels 47, when the tube is operating and the conducting band 43 is absent. However, with the conducting band 43 present as shown in FIGS. 1, 2 and 3, arcing in these channels is substantially entirely suppressed. Also, because the band 43 is positioned against the G3 and connected to and supported from the G3, the band 43 is more easily positioned during the fabrication of the mount assembly. Also, for the same reasons, the band 43 better maintains its location during the subsequent processing and ultimate use.

Figure 4:
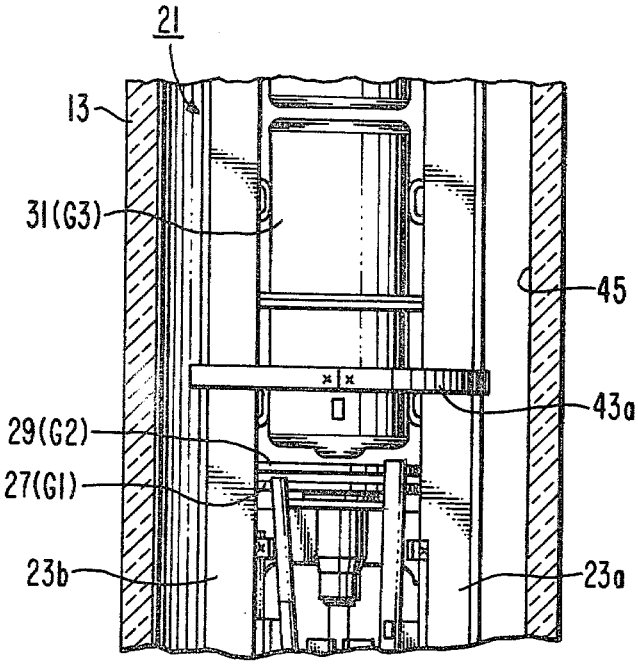
FIG. 4 is a fragmentary sectional elevational view of a second embodiment of the novel CRT.

FIG. 4 illustrates a second embodiment of the novel CRT that is similar to the CRT shown in FIG. 1 except that a metal ribbon 43*a* encircles the mount assembly over the G3 near the end toward the G2, that is, the low-voltage end of the G3. The ribbon 43*a* lays against those bead surfaces that face the inside surface 45 of the neck 13. The ribbon is about 2.0 mm wide, is about 0.1 mm thick, is of a nonmagnetic alloy and is welded near each of its ends to the G3. In still another embodiment not shown, the mount assembly may have two bands, one as shown in FIG. 1 and one as shown in FIG. 2. Two bands provide more arc suppression than one band but require additional material and labor. One band, preferably as shown in FIG. 1, is adequate for most structures. The CRT shown in FIG. 4 may be operated as described for the embodiment of FIG. 1. In other embodiments, the mount assembly may have two or more bands side by side located anywhere along the length of the G3.

Figure 5:
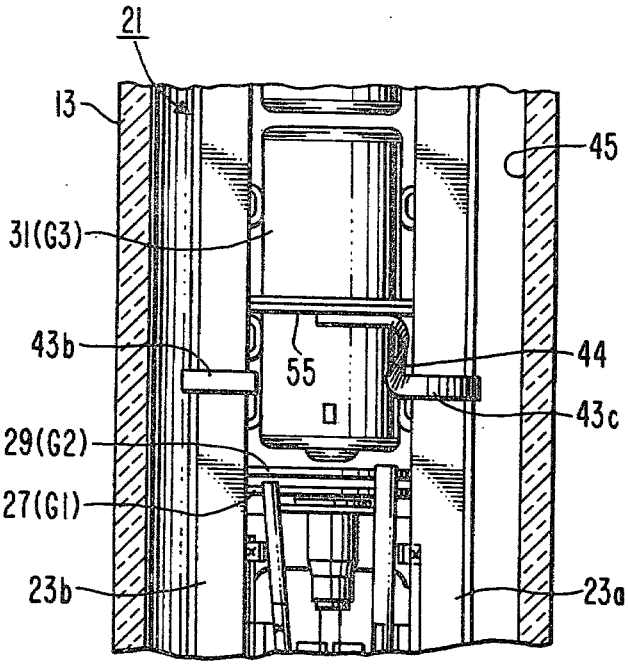
FIG. 5 is a fragmentary sectional elevational view of a third embodiment of the novel CRT.

FIG. 5 illustrates a third embodiment of the novel CRT that is similar to the CRT shown in FIG. 4 except that there are separate metal ribbons 43*b* and 43*c* around each of the support rods 23*a* and 23*b* respectively, near the low-voltage end of the G3. The ribbons 43*b* and 43*c* lay against those support surfaces that face the inside surface 45 of the neck 13. Each ribbon is about 2.0 mm wide, is about 0.1 mm thick, is of a nonmagnetic alloy and is welded near one of its ends to the flange 55 on the G3. If desired, each ribbon may be welded at both of its ends to the G3. The CRT shown in FIG. 5 may be operated as described for the embodiment of FIG. 1. In other embodiments, the mount assembly may have ribbons around each of the support rods at the high-voltage end of the G3 or both the low-voltage and high-voltage ends of the G3.

The presence of the suppressor band or bands as described above is to inhibit charge migration in the bead channels 47, which reduces or eliminates trigger arcing in the vicinity of the gap between the G3 and the G4. The suppressor band may be located in any location between the G3 and the neck on the mount assembly. The suppressor band may be used with any of the CRT electron-gun mount assemblies normally used, such as einzel, bipotential and tripotential mount assemblies in single-gun or multiple-gun versions. The band may be a wire, ribbon or strap of any width or thickness that is suitable for fabrication of the mount assembly. Since the band is positioned against the support rods and G3, there is no problem of proper outward spacing or vibration.

The suppressor band should be as free as possible of sharp points and edges that could be sources of electron field emission. The suppressor band can be in one piece, as shown in FIGS. 1 and 4, or can be split or segmented, as shown in FIG. 5. The split or segmented types may be preferred where the RF field normally used to heat and outgas the gun elements during exhaust operations unduly couples and overheats the band.

What is claimed is:

1. A cathode-ray tube comprising an evacuated envelope including an electrically-insulating neck, and an electron-gun mount assembly in said neck, said mount assembly comprising a plurality of electrodes including a screen grid electrode and a focus grid electrode closely spaced thereto, said electrodes being mounted on at least two electrically-insulating support rods, said assembly being closely spaced from the inner surface of said neck, and an electrically-conducting band part located against the surface of each of said suppport rods between said focus grid electrode and said neck, said band parts being electrically connected to and supported from said focus grid electrode.

2. The cathode-ray tube defined in claim 1 wherein said band parts are portions of a single band encircling said mount assembly and said band is welded to said focus grid electrode.

3. The cathode-ray tube defined in claim 1 wherein said band parts are portions of separate bands encircling each support rod, each band being separately welded to said focus grid electrode.

* * * * *

US004338543B1

REEXAMINATION CERTIFICATE (3762nd)

United States Patent [19] [11] B1 4,338,543

Handel [45] Certificate Issued May 18, 1999

[54] CRT WITH ARC SUPPRESSION MEANS THEREIN

[75] Inventor: Richard R. Handel, Lancaster, Pa.

[73] Assignee: RCA Licensing Corporation, Princeton, N.J.

Reexamination Request:
No. 90/004,766, Sep. 11, 1997

Reexamination Certificate for:

| | |
|---|---|
| Patent No.: | **4,338,543** |
| Issued: | **Jul. 6, 1982** |
| Appl. No.: | **06/048,827** |
| Filed: | **Jun. 15, 1979** |

[51] Int. Cl.[6] ..... H01J 29/46

[52] U.S. Cl. ..... 313/457; 313/417

[58] Field of Search ..... 313/417, 414, 313/457, 446

[56] References Cited

FOREIGN PATENT DOCUMENTS 51-147901 5/1978 Japan .

*Primary Examiner*—Vip Patel

[57] ABSTRACT

A CRT comprising an evacuated envelope having an electrically-insulating neck and a beaded electron-gun mount assembly housed in the neck. The beads of the assembly are closely spaced from the inner surface of the neck. An electrically-conducting band is located against the surface, each bead opposite the neck. The band is electrically connected to and supported from one of the electrodes of the mount assembly.

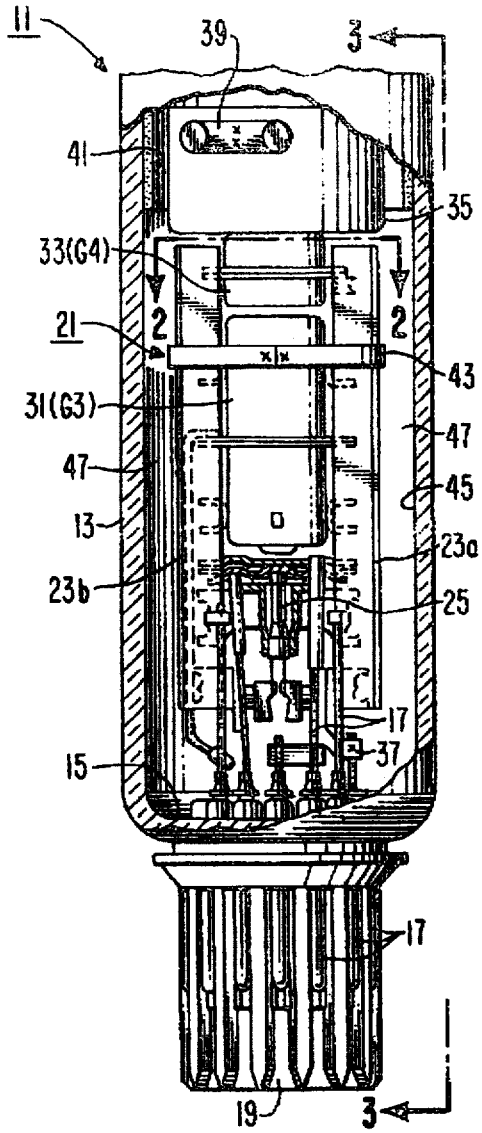

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are cancelled.

New claims 4–6 are added and determined to be patentable.

*4. A cathode-ray tub comprising an evacuated envelope including an electrically-insulating neck, and an electron-gun mount assembly in said neck, said mount assembly comprising a plurality of electrodes including a screen grid electrode and a focus grid electrode closely spaced thereto,*

*said focus grid electrode having a first end facing said screen grid electrode and said focus grid electrode having a second end opposite said first end, said electrodes being mounted on at least two electrically-insulating support rods, said assembly being closely spaced from the inner surface of said neck, and an electrically-conducting band part located against the surface of each of said support rods between said focus grid electrode and said neck, the band parts being electrically connected to and supported from said focus grid electrode, and said band parts being located nearer to said first end of said focus grid electrode than to said second end thereof.*

*5. The cathode-ray tube defined in claim 4, wherein said band parts are portions of a single band encircling said mount assembly, and said single band is welded to said focus grid electrode.*

*6. The cathode-ray tube defined in claim 5, wherein said band parts are portions of separate bands encircling each support rod and separately welded to said focus grid electrode.*

* * * * *